US009337556B2

(12) United States Patent
Rask

(10) Patent No.: US 9,337,556 B2
(45) Date of Patent: May 10, 2016

(54) PUMP UNIT WITH ELECTRICAL CONNECTION PLUG

(71) Applicant: GRUNDFOS HOLDING A/S, Bjerringbro (DK)

(72) Inventor: Torben Rask, Ans (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 0 days.

(21) Appl. No.: 14/372,134

(22) PCT Filed: Jan. 11, 2013

(86) PCT No.: PCT/EP2013/050486

§ 371 (c)(1),
(2) Date: Jul. 14, 2014

(87) PCT Pub. No.: WO2013/117381

PCT Pub. Date: Aug. 15, 2013

(65) Prior Publication Data

US 2015/0056874 A1 Feb. 26, 2015

(30) Foreign Application Priority Data

Feb. 8, 2012 (EP) ..... 12154462

(51) Int. Cl.

| | |
|---|---|
| ***H01R 4/52*** | (2006.01) |
| ***H01R 4/48*** | (2006.01) |
| ***F04D 13/06*** | (2006.01) |

(52) U.S. Cl.

CPC ..... *H01R 4/4827* (2013.01); *F04D 13/06* (2013.01); *F04D 13/0686* (2013.01); *H01R 4/4845* (2013.01)

(58) Field of Classification Search

CPC ..... H01R 4/4827; H01R 4/4845; H01R 4/48; F04D 13/0686; F04D 13/06

USPC ..... 439/836, 837, 441, 449, 835, 828

See application file for complete search history.

(56) References Cited

U.S. PATENT DOCUMENTS 5,679,021 A * 10/1997 Kramer ..... 439/835
5,810,625 A 9/1998 Klein et al.

FOREIGN PATENT DOCUMENTS

| | | | |
|---|---|---|---|
| DE | 44 13 611 | A1 | 10/1995 |
| DE | 297 07 710 | U1 | 6/1998 |
| DE | 20 2009 005366 | U1 | 7/2009 |
| EP | 0 632 529 | A2 | 1/1995 |
| EP | 2 072 828 | A1 | 6/2009 |
| EP | 2 199 617 | A2 | 6/2010 |

* cited by examiner

*Primary Examiner* — Javaid Nasri
(74) *Attorney, Agent, or Firm* — McGlew and Tuttle, P.C.

(57) ABSTRACT

A pump assembly is provided with an associated electrical connection plug, which is releasably connectable to an electrical plug coupling (10) of the pump assembly and includes a plug body (12) in which at least one electrical contact element (20), including a connection terminal (28) for receiving a connection wire (36), is arranged. The plug body (12) includes a receiver (40) for an opening element (42). The opening element (42) is insertable into the receiver in a removable manner, and the receiver (40) is arranged relative to the connection terminal (28) in a manner such that when the opening element (42) is inserted into the receiver (42), the opening element (42) acts on the connection terminal (28) and keeps this in an opened condition.

20 Claims, 3 Drawing Sheets

PUMP UNIT WITH ELECTRICAL CONNECTION PLUG

CROSS REFERENCE TO RELATED APPLICATIONS

This application is a United States National Phase Application of International Application PCT/EP2013/050486 filed Jan. 11, 2013 and claims the benefit of priority under 35 U.S.C. §119 of European Patent Application EP 12 154 462.1 filed Feb. 8, 2012, the entire contents of which are incorporated herein by reference.

FIELD OF THE INVENTION

The invention relates to a pump assembly and to an associated electrical connection plug which is releasably connectable to an electrical plug coupling of the pump assembly and comprises a plug body in which at least one electrical contact element, comprising a connection terminal for receiving a connection wire, is arranged.

BACKGROUND OF THE INVENTION

It is known to provide pump assemblies, for example heating circulation pump assemblies with electrical plug connections for the electrical connection, so that an electrical connection lead is firstly connected electrically to a connection plug which then can be inserted into an associated plug coupling on the pump assembly, in order to electrically connect the pump assembly. This design has the advantage that the housing of the pump assembly, in particular its electronics housing or terminal box does not need to be opened for the electrical connection.

With the known connection plugs for pump assemblies, it is common to provide screw terminals in the connection plug, on which screw terminals the connection wires are clamped by way of screws.

SUMMARY OF THE INVENTION

With regard to this state of the art, it is the object of the invention to improve a pump assembly with an associated electrical connection plugs, in a manner such that the electrical connection is further improved.

According to the invention, a pump assembly and an associated electrical connection plug are provided. The electrical connection plug is releasably connectable to electrical plug coupling of the pump assembly. The electrical connection plug includes a plug body. At least one electrical contact element, of the electrical connection plug, is arranged in the plug body. The at least one electrical contact element comprises a connection terminal for receiving a connection wire. The plug body comprises a receiver for an opening element. The opening element is insertable into the receiver in a removable manner. The receiver is arranged relative to the connection terminal in a manner such that when the opening element is inserted into the receiver, the opening element acts on the connection terminal and keeps the connection terminal in an opened condition.

The invention relates to a combination of a pump assembly and an associated electrical connection plug. Thereby, the electrical connection plug is releasably connectable to an electrical plug coupling of the pump assembly. I.e. the electrical connection plug and the plug coupling are designed corresponding to one another. Thus, the plug coupling can for example comprise electrical contact pins which project outwards and engage into corresponding female contacts on the connection plug. Vice versa, it is also possible to equip the connection plug with projecting contact pins, i.e. male contacts which engage into corresponding female contacts on the plug coupling. Moreover, the plug coupling on the pump assembly preferably comprises a receiver or recess, into which a correspondingly shaped part of the connection plug engages for a mechanical connection. Alternatively, the plug coupling can also be designed on the pump assembly as an outwardly projecting element which engages into a correspondingly shaped recess on the connection plug. Preferably, furthermore the connection plugs and/or plug coupling are provided with sealing elements, in order to create a sealed connection between the connection plug and the plug coupling and to protect the inner-lying electrical conductors from moisture or humidity from the outside.

The electrical connection plug comprises a plug body, in which at least one electrical contact element is arranged. The plug body has an engagement section which mechanically engages with the plug coupling on the pump assembly. The contact element, as previously described, is designed as a male or female contact, depending on how a corresponding contact is formed on the plug coupling. The at least one electrical contact element for the connection of a connection wire comprises a connection terminal, in which a connection wire can be electrically conductively clamped, wherein simultaneously a mechanical connection between the connection wire and the connection terminal is created.

According to the invention, the connection terminal is designed such that the plug body additionally comprises a receiver for an opening element serving for opening and closing the connection terminal. The connection terminal, with the aid of the opening element, can be brought into an open position which permits the introduction of the wire to be contacted and clamped, into the connection terminal. The connection terminal then without the opening element, preferably automatically gets into a closed position, in which a previously inserted connection wire is clamped and electrically contacted. In order to permit this, the receiver is arranged relative to the connection terminal such that when the opening element is inserted into the receiver, the opening element acts on the connection terminal and keeps this in an opened condition. I.e. preferably the receiver is formed adjacent or bordering the connection terminal in the inside of the plug body, so that the opening element applied into the receiver can come into contact with corresponding sections of the connection terminal, in order to move these into an opened position, in particular to press them into an opened position.

The receiver is designed such that the opening element is held and guided relative to the connection terminal, so that the opening element can exert a force onto the connection terminal, in order to open this. The receiver and the opening element are moreover preferably designed such that the opening element is held in the receiver with a non-positive and/or positive fit. By way of this, one succeeds in the opening element remaining in the receiver and in the plug body without an external force action, and the connection terminal thus being kept open and thus the connection wire being able to be easily inserted into the connection terminal without having to simultaneously actuate the connection from the outside in any manner whatsoever.

Moreover, the opening element and the receiver are preferably designed such that the opening element can only be inserted into the receiver in a defined position.

After inserting the connection wire, the opening element can then be removed from the receiver, by which means the connection terminal moves into the closed position and securely clamps the connection wire. The movement of the connection terminal into the closed position can either be effected automatically or however also by way of the movement of the opening element when this is removed or pulled out of the receiver.

Preferably, several electrical contact elements are arranged in the plug body. In particular, three electrical contact elements can be provided, as is common with electrical connection leads with a protective earthed conductor. The several contact elements in each case have a connection terminal for a connection wire, and the opening element and the receiver are designed and arranged such that when the opening element is inserted into the receiver, the opening element simultaneously acts on the connection terminals of several, preferably all contact elements and keeps this in an opened condition in each case. The electrical connection is further simplified by way of this, since the opening element simultaneously keeps all connection terminals in the opened condition, so that all connection wires can be applied into the respective connection terminals. Subsequently, the opening element can be removed from the receiver, by which means all connection terminals can be simultaneously moved into the closed condition. The connection terminals are thereby preferably designed such that they automatically remain in the closed condition and electrically contact and securely clamp the connection wires. Preferably, the several connection terminals are arranged lying next to one another and a plate-like connection element can be introduced at a common side of the several connection terminals, into a receiver placed there, in order to simultaneously act on the connection terminals. I.e. the opening and closing directions of the individual connection terminals preferably run parallel to one another, so that the opening element can act on all connection terminals in the same direction.

Further preferably, the opening element comprises several actuation sections, which are arranged such that they can act in each case on a connection terminal, wherein the actuation sections have at least one predetermined breaking location, preferably at their connection to the remaining parts of the opening element. For example, the actuation elements can be designed in the form of projections or tongues. Each of these projections or tongues can act on an associated connection terminal. This design has the advantage that opening elements can also be designed in a manner such that they do not simultaneously open all connection terminals, for example by way of an actuation element not being provided for each of the connection terminals, but only for a number and arrangement of actuation elements for those connection terminals which are to be opened by the opening element. In particular, if the actuation sections are fastened on the opening element by way of predetermined breaking locations, it is then also possible to break off individual actuation sections, so that the associated connection terminals are no longer opened on insertion of the opening element into the receiver. Thus, for example, it is possible in the case that after the removal of the opening element, it is ascertained that of several connection wires, only a few are correctly clamped, to break off the actuation sections for the connection terminals which are already correctly clamped and, when inserting the opening element into the receiver once again, to only open those connection terminals which have not correctly clamped a connection wire. It is also conceivable to arrange actuation elements for all presents connection terminals, on the opening element at one side, in particular side-edge, and to additionally arrange an individual actuation section at another, preferably far side-edge, with which individual actuation element an individual connection terminal can be opened in a targeted manner when the opening element is inserted with a side or side-edge into the receiver.

Preferably, the connection terminals are designed as spring terminals which are held in a closed condition by way of spring bias, in which condition a received connection wire is held in a clamping manner. The opening element and the receiver in this case are preferably designed and arranged such that the opening element inserted into the receiver holds the connection terminals in the opened condition against their spring bias. I.e. in particular, corresponding actuation sections of the opening element hold the respective connection terminals in the opened condition against their spring biasing. This design has the advantage that on removing the opening element, the connection terminals automatically close, and on account of the spring bias hold connection wires in a permanently clamped and contacted manner without external effect of force.

Further preferably, the connection terminals in each case comprise a spring clip (spring bow) which in the closed condition projects into the region of the receiver, into the plug body. Thus, an opening element which is inserted into the receiver can displace the spring clip present there, wherein the connection terminals are opened by way of the movement or the displacement of the spring clips.

The opening element for this preferably comprises at least one, preferably wedge-like press-surface which on insertion of the opening element into the receiver presses or moves the spring clip out of the region of the receiver. Such a press-surface is preferably formed on an actuation section of the opening element as has been previously described. Preferably, such press-surfaces are intended on each present actuation section. A simple insertion of the opening element is achieved by way of the wedge-like shape.

The plug body preferably at a first axial end forms a coupling section which is designed in a manner corresponding to the plug coupling of the pump assembly. Thus, the plug body and the plug coupling, as described above, can preferably engage into one another with a positive fit. Thereby, moreover, locking elements or clamping elements can be formed on the plug body and/or on the plug coupling, in order to lock both elements with one another, so that the connection pug is held on the pump assembly in a secure manner.

The connection terminals and the receiver for the opening element are further preferably open to a second axial end of the plug body which is away from the first axial end. The first axial end thereby lies preferably at the front in the joining direction on connection to the plug coupling, whereas the second axial end, in the joining direction, is situated on the rear side of the plug body. This arrangement has the advantage that the contact elements can extend in the axial direction through the plug body and at the first axial end can form contacts for contacting electrical contacts on the plug coupling, and at the opposite axial end can form the connection terminals for fixing the connection wires. The connection contacts are thereby preferably inserted into the plug body in the axial direction and there are held with a non-positive and/or positive fit. The insertion is preferably effected through openings on the second axial side of the plug body. The arrangement also of the receiver for the opening element at the second axial side moreover has the advantage that openings only need to be formed on two oppositely directed sides of the plug body, i.e. on sides which are directed opposite by 180°, so that the plug body as an injection molded part of plastic can be cast essentially without undercuts. This permits a simple design of the tool.

Preferably, the insertion direction of a connection wire into the connection terminal is directed parallel to the insertion direction and removal direction for the opening element out of the receiver. Further preferably, these insertion directions and removal directions are likewise directed parallel to the joining direction, in which the connection plug is connected to the plug coupling of the pump assembly. The assembly is very simple due to the fact that with this, all joining and insertion movements are effected in the same direction. In particular, the plug body can thus be held with one hand during the connection of the connection wires, whilst the connection wires can be led into the connection terminals with the other hand and subsequently the opening element can be pulled out of the receiver with the same hand. Thereby, the position of the plug body does not need to be changed, since connection wires and the opening element are introduced into the plug body and removed in the same direction, from the same side. A peripheral gripping is thus not necessary on assembly.

Moreover, the connection plug preferably comprises a cover cap which can be placed onto the second axial end of the plug body and thereby covers the openings of the connection terminals and the receiver. Preferably, a seal is provided between the connection cap and the plug body, so that a receiver space which is situated below the cover cap and in which the connection terminals and connection wires lie exposed, is insulated to the outside, in order to prevent a penetration of moisture into this region. The cover cap can be applied onto the plug body preferably in the same joining direction or insertion direction, in which the connection wires are also inserted into the connection terminals, and the opening element is pulled out of the receiver. Thus, the cover cap after the removal of the opening element can be stuck onto the plug body in the same direction without a peripheral gripping of the plug body becoming necessary. The cover cap and the plug body are preferably provided with locking elements which correspond to one another, by way of which the cover cap and the plug body can engage with one another in a locking manner. Thus, for example, projecting locking tongues with locking hooks can be formed on the plug body and these engage into corresponding locking recesses on the cover cap, wherein the locking hooks on the locking tongues engage behind contact shoulders on the locking recesses of the cover cap and thus fix the cover cap on the plug body with a positive fit. Thus, the complete connection plug can be easily assembled in a simple manner without a tool. The locking elements can thus be designed such that they can be opened with the help of the opening element. Thus, the opening element can be designed such that it can be introduced between locking hooks or locking projections and locking recesses, in order to disengage these. Thus, the opening element can simultaneously be used as a tool for opening the connection plug.

The cover cap further preferably comprises a cable feed-through which is preferably provided with a strain relief. Then a connection cable can be introduced from the outside into the connection space encompassed by the cover cap and preferably fixed with a non-positive and/or positive fit in the strain relief of the connection cap. Moreover, a seal can yet be provided in the region of the cable feed-through, in order to also seal the interior of the cover cap in this region. The seal then preferably comes to bear on the outer periphery of the introduced connection cable, in a sealed manner.

According to a further preferred embodiment, the opening element and the cover cap are designed in a manner such that when the opening element is located in the receiver in the plug body, an engagement of the cover cap and the plug body is prevented. This one can prevent the connection plug being closed by way of putting on the cover cap, as long as the connection terminals are not in their closed condition i.e. condition clamping the connection wires. Thus, an erroneous assembly can be avoided.

The opening element usefully comprises at least one actuation section which can be inserted into the recess, as well as a grip section projecting outwards out of the receiver. Thereby, as described above, several actuation elements can be provided. The grip section has the advantage that the opening element can be gripped without any problem, in order to withdraw it from the receiver or as the case may be, introduce it into the receiver. The grip section can thereby be additionally provided with an inscription for the connection terminals. I.e. this inscription can characterize the type of connection terminal, for example earth contact, live wire, etc.

When supplying the connection plug, the opening element is preferably already inserted into the receiver, so that the assembly is particularly simple, since it is then only the connection wires which must yet be inserted into the connection terminals, and the opening element removed from the receiver. However, it is also conceivable for the opening element to be supplied as a separate component, which before the connection of the connection wires must first be inserted into the receiver. With this design, the opening element can be arranged on a cover cap of the connection plug or housing part of the pump assembly or however can be part of a packaging of the connection plug or pump assembly. Thereby, the opening element is preferably connected to the remaining parts of the packaging via predetermined breakage locations. Thus, the opening element can for example be part of a blister packaging for the connection plug and be connected to the remaining parts of the blister packaging via a predetermined breakage location. The opening element can be broken away from the packaging and inserted into the receiver, in order to open the connection terminals for inserting the connection wires. This simplifies the manufacture, since the opening element can be manufactured together with the packaging and no additional individual part needs to be packaged or assembled. Moreover, the opening element can thus not get lost before the assembly. The opening element is preferably manufactured of plastic. Thus, for example, it can be formed as part of a blister packaging which is likewise manufactured of plastic. Alternatively however, it would also be conceivable to design the opening element of cardboard. It can thus form a part of a packaging part manufactured of cardboard. In the case that the opening element is formed on another component such as on a part of the pump housing, for example part of a terminal box or the cover cap of the connection plug, then the opening element can be designed as a projection there. Thereby, the opening element is preferably manufactured as one piece with the respective component. This too is particularly preferably possible if the respective parts are manufactured as molded plastic parts.

The plug body and the cover cap are likewise preferably manufactured of plastic. This permits an inexpensive manufacture. Moreover, the parts have the necessary insulating properties. Possible seals which are arranged on the components, as have been described above, can be formed as separate inserted elements or however with two-component injection molding can be directly injection molded onto the respective components. The seals are thereby preferably manufactured of an elastomer.

Apart from the previously described combination of pump assembly and associated connection plug, the invention likewise relates alone to a connection plug for a pump assembly. This comprises a plug body, in which at least one electrical contact element is arranged, said contact element comprising a connection terminal for receiving a connection wire. Additionally, the connection body, as described above, comprises a receiver for an opening element which can be inserted into the receiver in a removable manner. The receiver is arranged relative to the contact element in a manner such that when the opening element is inserted into the receiver, the opening element acts on the connection terminal and maintains this in the opened condition. The function of this connection plug, its advantages and possible preferred design are to be deduced from the preceding description, in which the connection plug has been described in combination with the associated pump assembly. It is to be understood that the individual connection plug can be designed accordingly.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
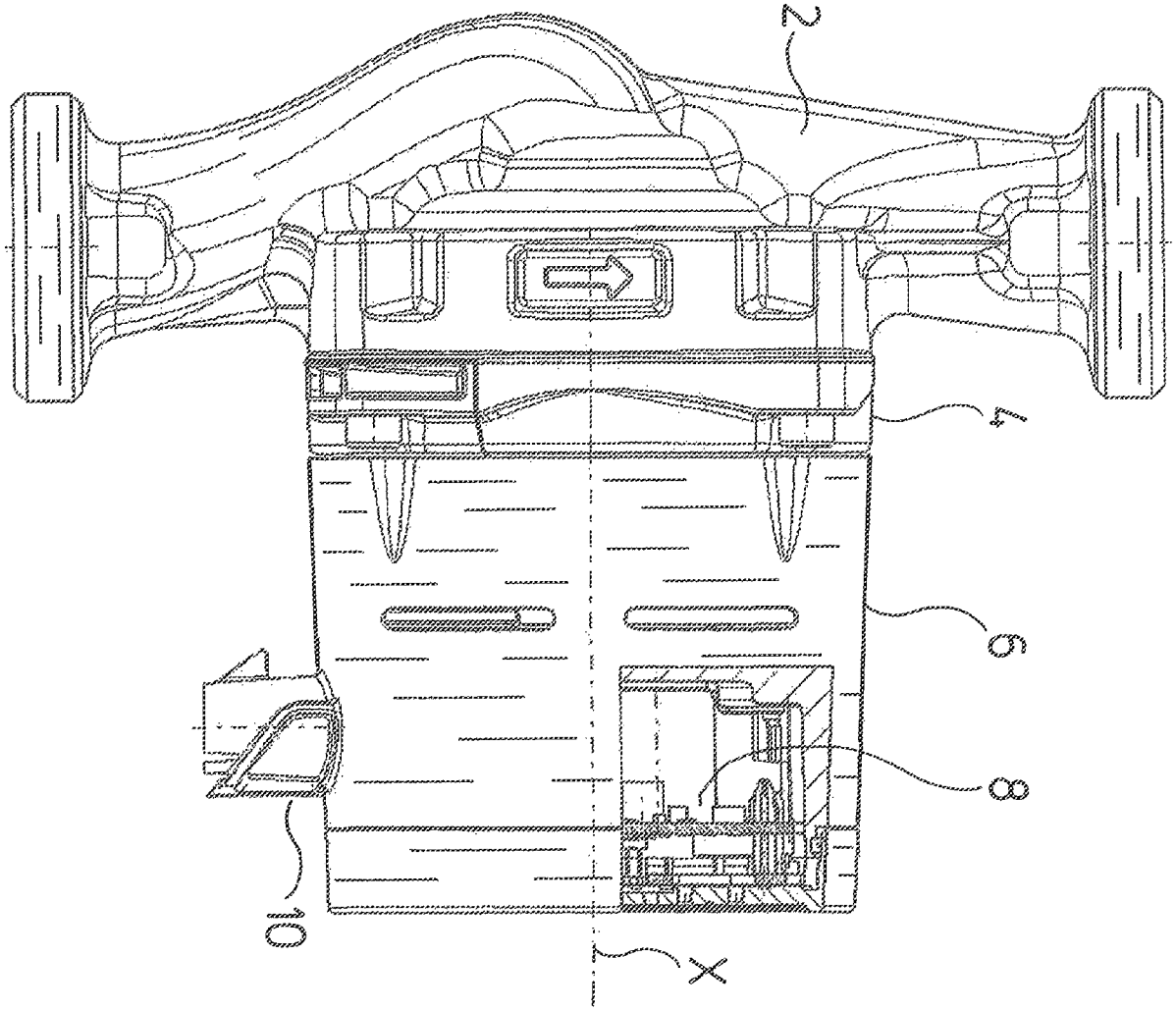
FIG. 1 is a partly sectioned entire view of a pump assembly according to the invention.
Figure 2:
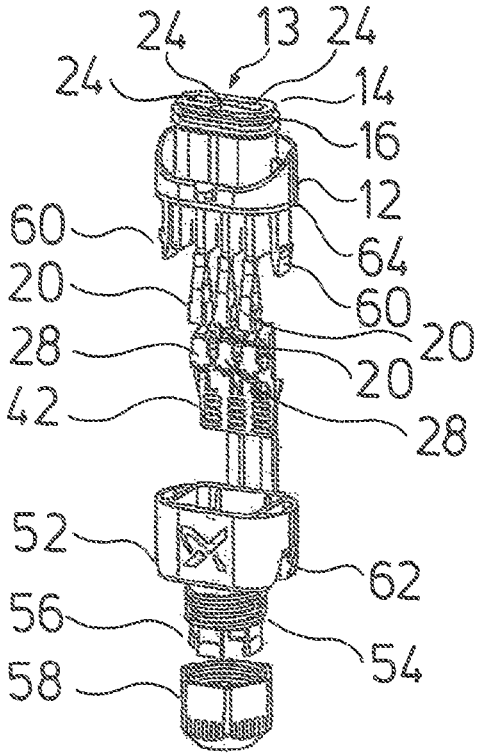
FIG. 2 is an exploded view of the associated connection plug.
Figure 3:
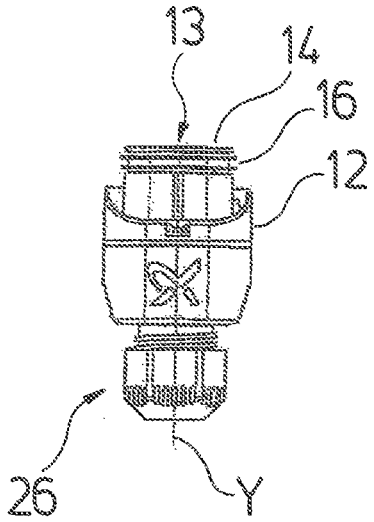
FIG. 3 is a plan view of the closed connection plug.
Figure 4:
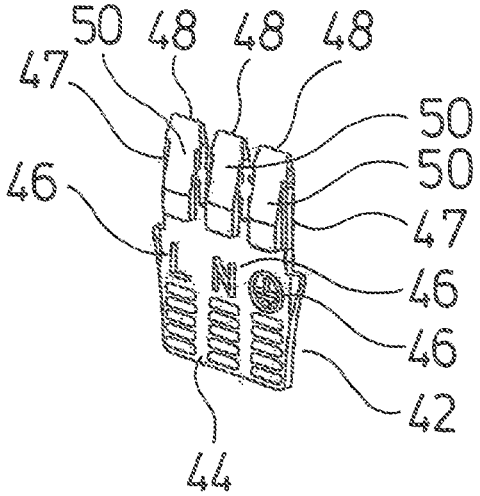
FIG. 4 is a perspective detailed view of the opening element.

Referring to the drawings in particular, the pump assembly with which the invention is concerned, in the known manner comprises a pump housing 2, in which an impeller not shown here is arranged and which is connected to the stator housing 4, in which an electrical drive motor is arranged for the drive of the impeller. An electronics housing or terminal box 6, in which electronic components 8 for the control or regulation of the electrical drive motor in the stator housing 4 are arranged, is applied axially onto the stator housing 4 in the direction of the longitudinal axis or rotation axis X. The terminal box 6 is provided with a plug coupling 10 for the electrical connection.

A connection plug which is shown in the FIGS. 2, 3, 5 and 6 corresponds with this plug coupling 10. The connection plug comprises a plug body 12 which at a first axial end forms a coupling section 14. The coupling section 14 is shaped in a manner corresponding to the plug coupling 10 and can engage with this. The coupling section 14 peripherally comprises a seal 16 of an elastomer material which can come to bear on the inner periphery of the plug coupling 10 in a sealing manner.

The plug body 12 comprises recesses 18 which extend in the longitudinal direction or axial direction Y and in which contact elements 20 are inserted. The contact elements 12 are formed on their first axial end as female contacts 22 which lie opposite axial-side openings 24 of the recesses 18. The openings 24 are open to the first axial end 13 of the connection plug. Male contacts or contact pins which are arranged in the plug coupling 10 of the pump assembly can engage through the openings, and in the inside of the recesses 18 can engage with the female contacts 22 which are formed by the contact elements 20. With the connection plug shown here, three recesses 18 are provided with three contact elements 20, one for the live conductor, one for the neutral conductor and one for the earth conductor.

The contact elements 20 at their second end which is opposite to the female contacts 22 are designed as connection terminals 28, facing the second axial end 26 of the connection plug. The connection terminals 28 are formed from sheet metal and as one piece with the remaining parts of the contact elements 20, as spring terminals.

The connection terminals 28 each comprise a contact limb 30, around which a spring clip 32 engages. The spring clip 32 comprises an opening 34, through which the contact limb 30 extends and into which a connection wire 36 of a connection cable or a connection conduit 38 can be inserted.

Figure 5:
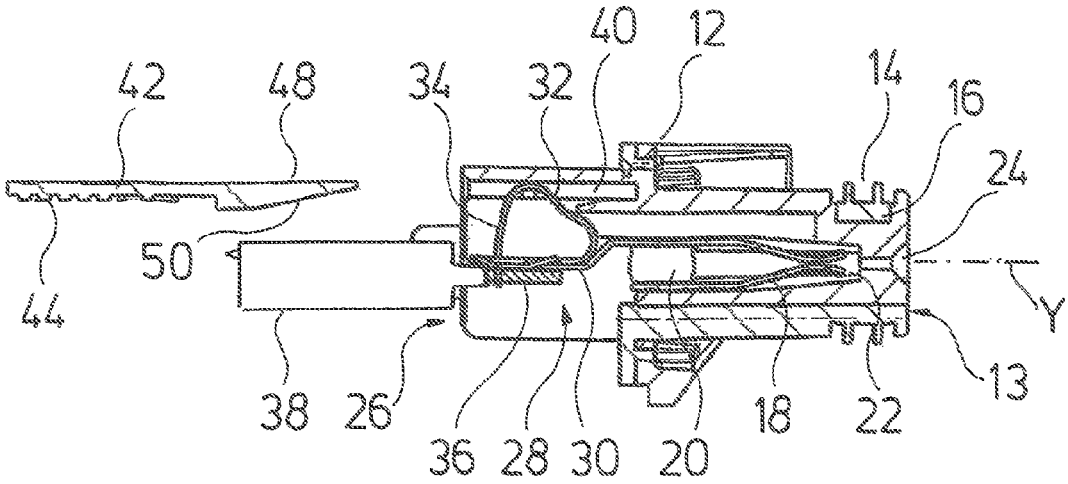
FIG. 5 is a sectioned view of the connection plug with a removed opening element.

The three recesses 18 with the contact elements 20 arranged therein are arranged lying next to one another in a plane, so that the longitudinal axes of the contact elements 20 extend parallel to the longitudinal axis Y of the connection plug. The longitudinal axis Y of the connection plug thereby corresponds to the joining direction, in which the connection plug is inserted into the plug coupling 10. Simultaneously, this is the direction in which the connection wires 36 are inserted into the openings 34 of the connection terminals 28. A receiver 40 is arranged in the plug body 12, in a manner laterally distanced in parallel to the plane, in which the recesses 18 are situated (in FIGS. 5 and 6 above the contact elements 20 and their connection terminals 28). The receiver 40 is designed in a slot-like manner and as is the case with the connection terminals 28, is open to the second axial end 26 of the plug body 12. The receiver 40 is situated such that in a closed condition of the connection terminals 28, the spring clips 32 extend in each case into the receiver 40. In the closed condition of the connection terminals, a connection wire 36 is clamped in the connection terminals 28 in each case. This is effected due to the spring clip 32 moving on account of its spring bias, such that an inner side of the opening 34 is moved to the abutment limb 30, so that the connection wire 36 is clamped between the abutment limb 30 and an inner edge or inner side of the opening 34, as is shown in FIG. 5.

Figure 6:
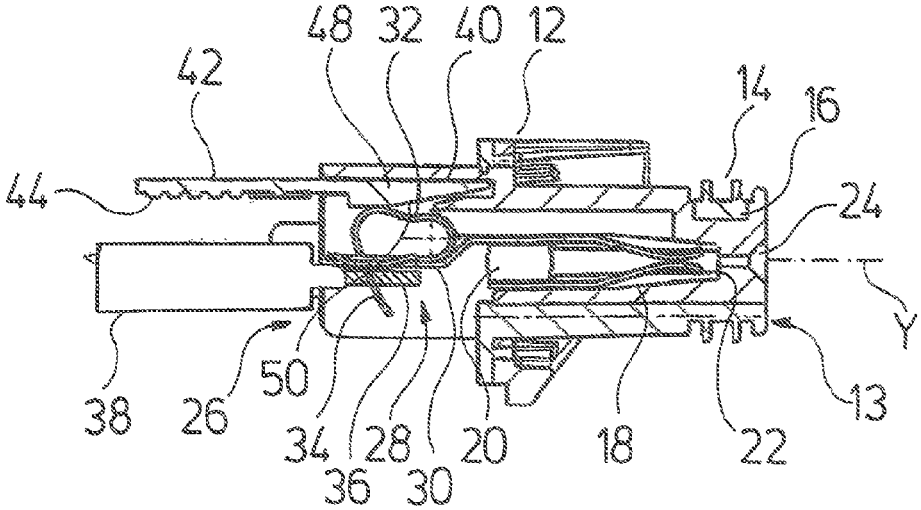
FIG. 6 is a sectioned view according to FIG. 5, with an inserted opening element.

An opening element 42 is inserted into the receiver 40 for opening the connection terminals 28. The opening element 42 is designed in a plate-like manner and at an axial end comprises a grip section 44 which serves for gripping the opening element 42. The grip section 44 comprises a corrugated surface structure, so that it can be well gripped. When the opening element 42, as is shown in FIG. 6, is inserted into the receiver 40 in the direction of the longitudinal axis Y of the plug body 12, this grip section at the second axial end 26 extends outwards out of the plug body 12. The grip section 44 is moreover provided with an inscription 46 which characterizes the three connection terminals 28, specifically here live conductor, neutral conductor and earth conductor. At the opposite axial end of the grip section 44, the opening element 42 comprises three actuation sections 48 which extend in a tongue-like manner and which are designed for insertion into the receiver 40. The receiver 40 for this is subdivided into three receiver spaces, wherein in each case one of the actuation sections 48 engages into each receiver space. The actuation sections 48 are distanced such that in each case one actuation section 48 comes to bear laterally, which is to say in FIGS. 5 and 6 above exactly one end-clamp when the opening element 42 is inserted into the receiver 40.

The actuation sections 48 have wedge-like press surfaces 50 which on insertion of the actuation elements 48 into the receiver 40 come into contact with the spring clips 32 of the connection terminals 28. Thereby, the actuation sections 48 displace the oppositely lying or adjacent spring clip 32 out of the receiver 40, by which means the spring clip 32 is displaced in the direction of the abutment limb 30, so that the inner edge of the opening 34 which lies opposite the abutment limb 30 moves away from this, so that the opening 34 between the abutment limb and the oppositely lying inner edge of the opening 34 increases. Thus, the open position of FIG. 6 is achieved, in which a connection wire 36 is not clamped in the connection terminal 28 but can be inserted into this and be removed from this again. Simultaneously, the opening element 42 is held in the receiver 40 with a non-positive fit by way of the spring clips 32, so that a fixed opened condition is reached as long as the opening element 42 is inserted in the receiver 40. In this condition, the connection wires 35 can be inserted into the connection terminals 28 or the openings 34 of the spring clips 32 without a further tool. When all three connection wires 36 are inserted, the opening element 42 is pulled out of the receiver 40 in the direction of the longitudinal axis Y, so that then the spring clips 32 on account of the spring bias automatically move back into the receiver 40 and simultaneously reduce the size of the opening 34 and clamp the respective connection wire 36 between the inner edge of the opening 34 and the contact limb 30 as is shown in FIG. 5. In this condition, a secure fixation and contacting of the connection wires 36 in the connection terminals 28 is given, wherein this clamping on the one hand is with a non-positive fit and on the other hand the inner edge of the opening 34 can cut into the connection wire 36 to a certain extent, so that a positive-fit fixation is simultaneously achieved.

The individual actuation sections 48 comprise lateral guide projections 47 which extend in the direction of the longitudinal axis Y of the plug body and which can engage into corresponding grooves in the inside of the receiver 40. The guide projections 47 and the corresponding grooves in the receiver 40 are designed such that the opening element 42 can be introduced into the receiver 40 only in a predefined position and in particular cannot be inserted into the receiver 40 in a position rotated by 180° about the longitudinal axis Y.

The individual actuation sections 48 can be connected to the grip section 44 via predetermined breakage locations, so that they can be broken away individually. This, by way of breaking away the non-required actuation sections, permits the opening element 42 to be designed such that on inserting, only one or two connection terminals 28 are opened in the previously described manner. This, for example, can be useful if on applying the connection wires 36 for the first time, one of the connection wires 36 for example has not been correctly inserted and clamped. This connection terminal 28 can then be opened once again in a targeted manner without having to open the other correctly clamped connection terminals 28 once again. For this, the actuation sections 48 which are assigned to the correctly clamped connection terminals 28 can be separated from the opening element 42.

After removal of the opening element 42, a cover cap 52 which comprises a cable feed-through 54 for a connection lead 38 is applied onto the plug body 12. The cable feed-through 54 is provided with a strain relief 56 which is clamped or fixed by way of a union nut 58. The cover cap 42 via locking hooks 60 which are formed on the plug body 12 is fixed on the plug body with a positive fit, by way of the locking hooks 60 engaging behind contact shoulders 62 on locking recesses on the cover cap 52. Moreover, a seal 64 is provided between the plug body 12 and the cover cap 52. A seal which is not shown here is also provided in the strain relief 56.

The grip section 44 of the opening element 42 is designed so long that when the opening element 42 is inserted into the receiver 40, the grip section 44 projects in the axial direction Y so far from the second axial end 26 that on placing on the cover cap 52, it abuts the inner side of this before the locking hooks 60 engage behind the contact shoulders 62. In this manner, one prevents the cover cap 52 not being able to be connected to the plug body 12 as long as the opening element 42 is still inserted in the receiver 40.

While specific embodiments of the invention have been shown and described in detail to illustrate the application of the principles of the invention, it will be understood that the invention may be embodied otherwise without departing from such principles.

The invention claimed is:

1. A pump assembly and an associated electrical connection plug comprising:

an electrical plug coupling of the pump assembly, the electrical connection plug being releasably connectable to electrical plug coupling;

a plug body of the electrical connection plug;

at least one electrical contact element, of the electrical connection plug, arranged in the plug body, the at least one electrical contact element comprising a connection terminal for receiving a connection wire, wherein:

the plug body comprises a receiver for an opening element;

the opening element is held in the receiver with one or more of a non-positive fit and a positive fit;

the opening element is insertable into the receiver in a removable manner; and the receiver is arranged relative to the connection terminal in a manner such that when the opening element is inserted into the receiver, the opening element acts on the connection terminal and keeps the connection terminal in an opened condition.

2. A pump assembly and connection plug according to claim 1, wherein several electrical contact elements are arranged in the plug body and in each case comprise a connection terminal for a connection wire, and the opening element and the receiver are designed and arranged such that when the opening element is inserted into the receiver, the opening element acts simultaneously on the connection terminals of several contact elements and keeps the contact elements, in each case, in an opened condition.

3. A pump assembly according to claim 2, wherein:

the opening element comprises several actuation sections which are arranged such that they act in each case on a connection terminal; and the actuation sections comprise a predetermined breakage location at a connection to remaining parts of the opening element.

4. A pump assembly and connection plug according to claim 1, wherein:

at least one said connection terminal comprises spring terminals which, by way of a spring bias, are held in a closed condition, in which a received connection wire is held in a clamping manner; and the opening element, inserted into the receiver, holds the at least one said connection terminal in the opened condition against the spring bias.

5. A pump assembly and a connection plug according to claim 4, wherein the at least one said connection comprises a spring clip which in the closed condition projects into the region of the receiver in the plug body.

6. A pump assembly and connection pug according to claim 5, wherein the opening element comprises at least one wedge-like press-surface which on insertion of the opening element into the receiver presses the spring clip out of the region of the receiver.

7. A pump assembly and connection plug according to claim 1, wherein the plug body, at a first axial end, forms a coupling section which is designed in a manner corresponding to the plug coupling of the pump assembly.

8. A pump assembly and connection plug according to claim 7, wherein at least one said connection terminal and the receiver, for the opening element, are open to a second axial end of the plug body which is away from the first axial end.

9. A pump assembly according to claim 8, wherein the insertion direction of the connection wire into the connection terminal is directed parallel to the insertion and removal direction for the opening element out of the receiver.

10. A pump assembly and connection plug according to claim 8, wherein the connection plug comprises a cover cap which can be applied onto the second axial end of the plug body and thereby covers the openings of the connection terminals and of the receiver.

11. A pump assembly and connection plug according to claim 10, wherein the cover cap and the plug body are provided with locking elements which correspond to one another and by way of which the cover cap and the plug body can come into engagement with one another in a locking manner.

12. A pump assembly and connection plug according to claim 10, wherein the cover cap comprises a cable feed-through which is provided with a strain relief.

13. A pump assembly and connection plug according to claim 10, wherein the opening element and the cover cap are designed in a manner such that an engagement of the cover cap and the plug body is prevented when the opening element is located in the receiver in the plug body.

14. A pump assembly and connection plug according to claim 1, wherein the opening element comprises at least one actuation element which can be applied into the receiver, as well as a grip section which projects outwards out of the receiver.

15. A pump assembly and connection plug according to claim 14, wherein the grip section is provided with a labelling for the connection terminals.

16. A pump assembly according to claim 1, wherein the opening element is arranged on a cover cap of the connection plug or on a housing part of the pump assembly or is part of a packaging of the connection plug or of the pump assembly and is preferably connected to the remaining parts of the packaging via a predetermined breakage location.

17. A connection plug for a pump assembly, the connection plug comprising:

a plug body;

at least one electrical contact element arranged in the plug body, said contact element comprising a connection terminal for receiving a connection wire, wherein the plug body comprises a receiver for an opening element, wherein the opening element is insertable into the receiver in a removable manner and the receiver is arranged relative to the contact element in a manner such that when the opening element is inserted into the receiver, the opening element acts on the connection terminal and holds the connection terminal in an opened condition, wherein at least a portion of said opening element is arranged in an interior space of said receiver when the opening element is inserted into the receiver, said at least said portion of said opening element and said receiver being connected via one or more of a positive connection and a non-positive connection when the opening element is inserted into the receiver.

18. A connection plug according to claim 17, wherein several electrical contact elements are arranged in the plug body and in each case comprise a connection terminal for a connection wire, and the opening element and the receiver are designed and arranged such that when the opening element is inserted into the receiver, the opening element acts simultaneously on the connection terminals of several contact elements and keeps the contact elements, in each case, in an opened condition.

19. A connection plug according to claim 18, wherein:

the opening element comprises several actuation sections which are arranged such that they act in each case on at least one said connection terminal, wherein; and the actuation sections comprise a predetermined breakage location at a connection to remaining parts of the opening element.

20. A connection plug according and connection plug according to claim 17, wherein:

at least one said connection comprises spring terminals which, by way of a spring bias, are held in a closed condition, in which a received connection wire is held in a clamping manner; and the opening element, inserted into the receiver, holds the connection terminals in the opened condition against the spring bias.

* * * * *